US008600257B2

(12) United States Patent
Yamada

(10) Patent No.: US 8,600,257 B2
(45) Date of Patent: Dec. 3, 2013

(54) PRINTING DEVICE HAVING CORRECTING FUNCTION

(75) Inventor: Akihiro Yamada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 242 days.

(21) Appl. No.: 13/028,469

(22) Filed: Feb. 16, 2011

(65) Prior Publication Data

US 2011/0262171 A1 Oct. 27, 2011

(30) Foreign Application Priority Data

Apr. 27, 2010 (JP) ..... 2010-102231

(51) Int. Cl.
*G03G 21/00* (2006.01)

(52) U.S. Cl.
USPC ..... 399/75; 399/38; 399/58

(58) Field of Classification Search
None
See application file for complete search history.

(56) References Cited

U.S. PATENT DOCUMENTS

| | | | | |
|---|---|---|---|---|
| 6,553,191 | B1 * | 4/2003 | Nakane | 399/38 |
| 2009/0141298 | A1 | 6/2009 | Kushida | |

FOREIGN PATENT DOCUMENTS

| | | |
|---|---|---|
| JP | 2002-229278 | 8/2002 |
| JP | 2006-201457 | 8/2006 |
| JP | 2006-330686 | 12/2006 |
| JP | 2008-134464 | 6/2008 |
| JP | 2009-134149 | 6/2009 |

OTHER PUBLICATIONS

Office Action for corresponding Chinese Patent Application No. 201110084191.0 dated Jul. 25, 2013.

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

A correction unit executes a correcting function for measuring at least one of position and density of a test image in response to a correction instruction and correcting an operation setting of a printing unit based on the measurement result. Print data includes correction requiring data that is required to execute the correcting function by the correction unit before an image corresponding to the correction requiring data is printed. A determining unit is configured to determine whether or not at least one of two conditions is satisfied. One condition is such that a ratio of a second numerical value represented by the correction requiring data to a first numerical value represented by the print data is less than a first reference value. Another condition is such that the second numerical value is less than a second reference value. When the determining unit determines that the at least one of two conditions is satisfied, the control unit bypasses the measurement by the correction unit even if a receiving unit receives the correction instruction.

8 Claims, 5 Drawing Sheets

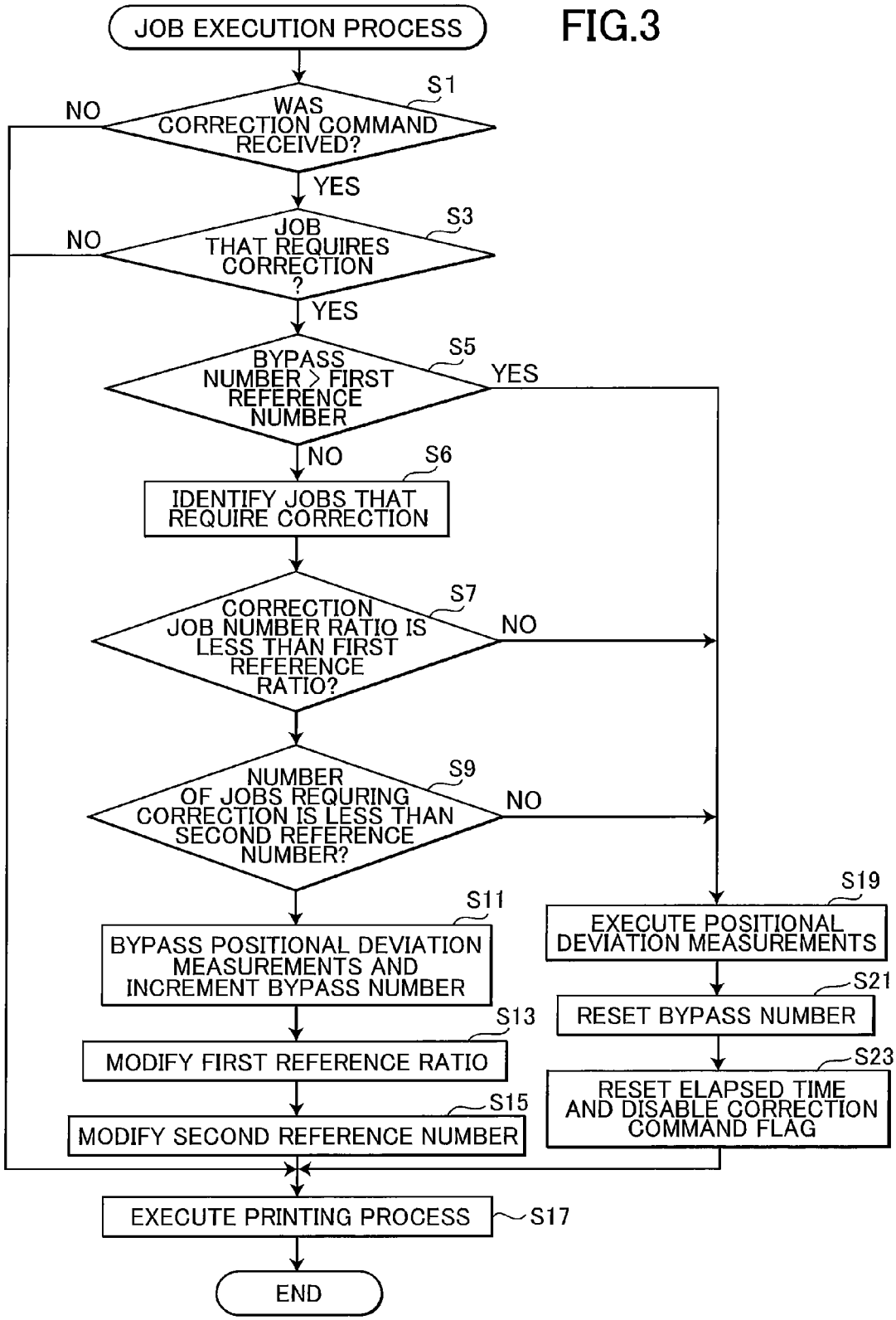
JOB EXECUTION PROCESS
FIG.3
S1
WAS CORRECTION COMMAND RECEIVED?
NO
YES
S3
JOB THAT REQUIRES CORRECTION ?
NO
YES
S5
BYPASS NUMBER > FIRST REFERENCE NUMBER
YES
NO
S6
IDENTIFY JOBS THAT REQUIRE CORRECTION
S7
CORRECTION JOB NUMBER RATIO IS LESS THAN FIRST REFERENCE RATIO?
NO
S9
NUMBER OF JOBS REQURING CORRECTION IS LESS THAN SECOND REFERENCE NUMBER?
NO
S11
BYPASS POSITIONAL DEVIATION MEASUREMENTS AND INCREMENT BYPASS NUMBER
S13
MODIFY FIRST REFERENCE RATIO
S15
MODIFY SECOND REFERENCE NUMBER
S19
EXECUTE POSITIONAL DEVIATION MEASUREMENTS
S21
RESET BYPASS NUMBER
S23
RESET ELAPSED TIME AND DISABLE CORRECTION COMMAND FLAG
EXECUTE PRINTING PROCESS
S17
END

FIG.4

| BYPASS NUMBER | 0～4 | 5～9 | 10～14 | 15～ |
|---|---|---|---|---|
| FIRST REFERENCE RATIO | 30% (INITIAL VALUE) | 20% | 10% | 5% |

FIG.5

| ELAPSED TIME | LESS THAN 2 HOURS | AT LEAST 2 HOURS BUT LESS THAN 4 HOURS | AT LEAST 4 HOURS BUT LESS THAN 6 HOURS | MORE THAN 6 HOURS |
|---|---|---|---|---|
| SECOND REFERENCE NUMBER | 4 | 3 | 2 | 1 |

PRINTING DEVICE HAVING CORRECTING FUNCTION

CROSS REFERENCE TO RELATED APPLICATION

This application claims priority from Japanese Patent Application No. 2010-102231 filed Apr. 27, 2010. The entire content of the priority application is incorporated herein by reference.

TECHNICAL FIELD

The present invention relates to a printing device having a correcting function for measuring deviations in the positions and densities of formed images and the like and for adjusting an operation setting based on the measurement results.

BACKGROUND

A conventional printing device implements a correcting function for measuring deviations in the positions, densities, and the like of formed images and for adjusting the operation setting based on these measurements, for example. Specifically, on the condition that a printing request to perform a color printing operation and a correction command are received, a conventional printing device having this correcting function executes a correction process prior to performing the printing operation based on the printing request.

SUMMARY

However, this conventional printing device always executes the correction process when the above condition are met, regardless of the amount of color data included in the print jobs that requires execution of the correction process in one print job or a plurality of consecutive print jobs. Therefore, the conventional printing device measures deviations in positions and densities of images in the correction process prior to printing a print job when a correction command is received, even when the print job includes nine monochrome pages and only one color page, for example. As a result, the printing operation is delayed for all pages in the print job, even though the nine monochrome pages inherently do not require execution of the correction process.

In other words, in order to execute a correction process for data that requires this process, printing of data not requiring the correction process is also delayed. For this reason, there is a need to improve the efficiency of the correcting function. Since deviations in the positions and densities of images formed in monochrome printing have a relatively small effect on image quality, the correction process is generally not executed for monochrome images in order to reduce processing load.

In view of the foregoing, it is an object of the present invention to provide a printing device and a program for the printing device capable of improving the efficiency of this correcting function.

In view of the foregoing, it is an object of the present invention to provide a printing device including a memory unit, a printing unit, a receiving unit, and a processor. The memory unit stores print data. The printing unit is configured to print an image corresponding to the print data and a test image based on an operation setting. The receiving unit receives a correction instruction. The processor is configured to execute instructions that cause the processor to provide functional units including: a correction unit, an extracting unit, a determining unit, and a control unit. The correction unit executes a correcting function for measuring at least one of position and density of the test image in response to the correction instruction and correcting the operation setting based on the measurement result. The print data includes correction requiring data that is required to execute the correcting function by the correction unit before an image corresponding to the correction requiring data is printed. The extracting unit is configured to extract the correction requiring data from the print data stored in the memory. The print data represents a first numerical value of a print matter. The correction requiring data represents a second numerical value of the print matter. The determining unit is configured to determine whether or not at least one of two conditions is satisfied. One condition is such that a ratio of the second numerical value to the first numerical value is less than a first reference value. Another condition is such that the second numerical value is less than a second reference value. When the determining unit determines that the at least one of two conditions is satisfied, the control unit bypasses the measurement by the correction unit even if the receiving unit receives the correction instruction.

According to another aspect, the present invention provides a non-transitory computer readable storage medium storing a set of program instructions installed on and executed by a printing device. The printing device includes a memory unit that stores print data, a printing unit that is configured to print an image corresponding to the print data and a test image based on an operation setting, and a receiving unit that receives a correction instruction. The set of program instructions comprising: executing a correcting function for measuring at least one of position and density of the test image in response to the correction instruction and correcting the operation setting based on the measurement result, the print data including correction requiring data that is required to execute the correcting function before an image corresponding to the correction requiring data is printed, extracting the correction requiring data from the print data stored in the memory, the print data representing a first numerical value of a print matter, the correction requiring data representing a second numerical value of the print matter; determining whether or not at least one of two conditions is satisfied, one condition being such that a ratio of the second numerical value to the first numerical value is less than a first reference value, another condition being such that the second numerical value is less than a second reference value; and bypassing, when it is determined that the at least one of two conditions is satisfied, the measurement even if the receiving unit receives the correction instruction.

BRIEF DESCRIPTION OF THE DRAWINGS

The particular features and advantages of the invention as well as other objects will become apparent from the following description taken in connection with the accompanying drawings, in which:

FIG. 3 is a flowchart illustrating steps in a job execution process executed on the printer according to the first embodiment;

FIG. 4 is a table showing correlation data for bypass number and first reference ratio;

FIG. 5 is a table showing correlation data for elapsed time and second reference number.

DETAILED DESCRIPTION

First Embodiment

Next, a first embodiment of the present invention will be described while referring to FIGS. 1 through 5.

(Overall Structure of a Printer)

Figure 1:
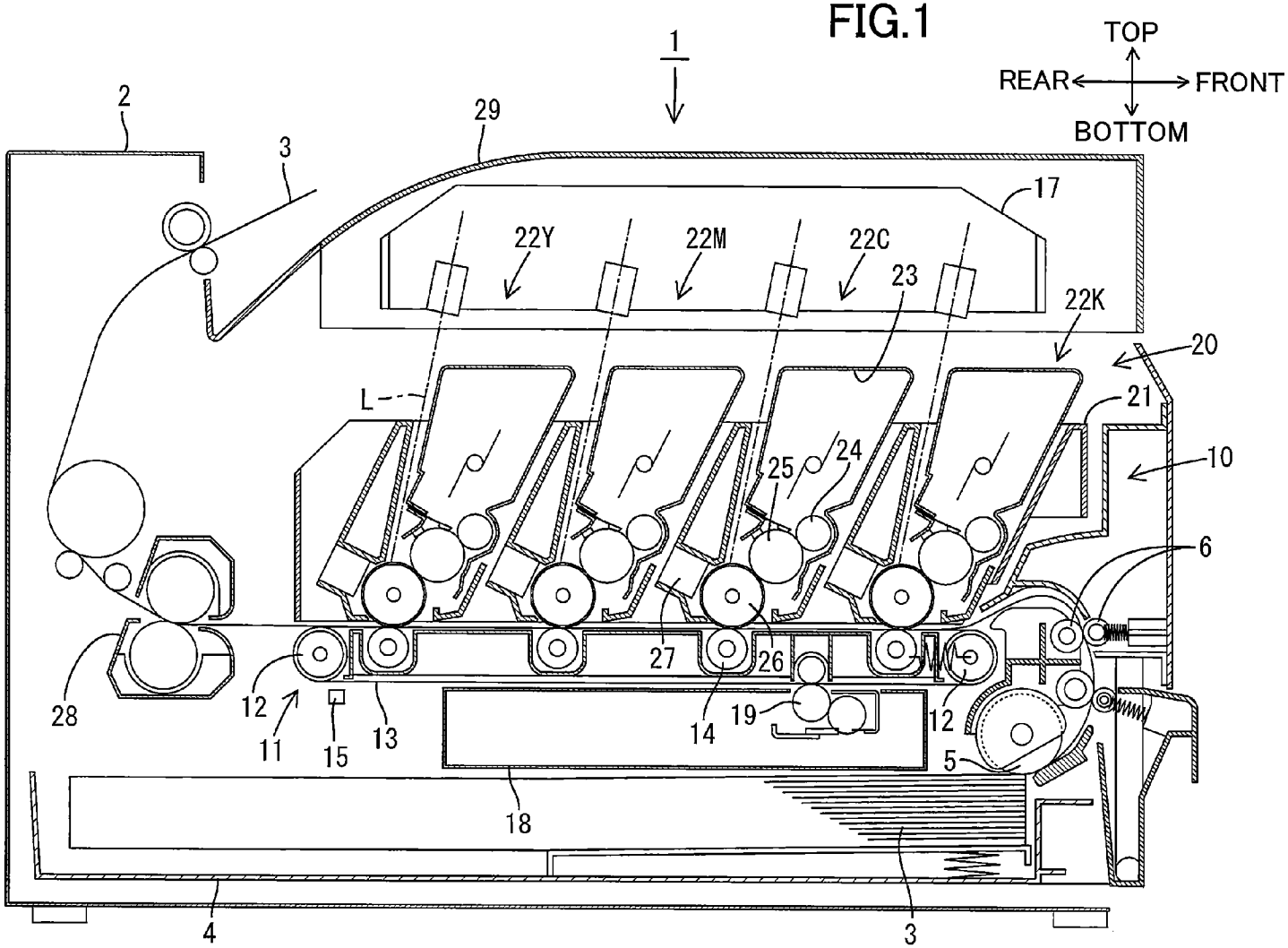
FIG. 1 is a side cross-sectional view showing an overall structure of a printer according to a first embodiment of the present invention.

FIG. 1 is a side cross-sectional view showing the overall structure of a printer 1. The terms "above", "below", "front", "rear" and the like will be used throughout the description assuming that the printer 1 is disposed in an orientation in which it is intended to be used. More specifically, in FIG. 1, a right side and a left side are a front side and a rear side, respectively.

The printer 1 includes a casing 2. A sheet-feeding tray 4 is disposed in the bottom section of the casing 2. A plurality of sheets 3 of a recording medium, such as paper, is stacked in the sheet-feeding tray 4. A pickup roller 5 is disposed above the front edge of the sheet-feeding tray 4. By rotating, the pickup roller 5 feeds the topmost sheet 3 in the sheet-feeding tray 4 to a pair of registration rollers 6 disposed downstream in a sheet feeding direction. The registration rollers 6 correct any skew in the sheet 3 and subsequently convey the sheet 3 onto a belt unit 11 of a printing unit 10 described next.

The printing unit 10 includes the belt unit 11, a scanning unit 17, a process unit 20, and a fixing unit 28.

The belt unit 11 is configured of a pair of front and rear support rollers 12 and a belt 13 looped around the support rollers 12. The belt 13 is configured of a polycarbonate material. When the belt 13 is driven to circulate, a sheet 3 resting on top of the belt 13 is conveyed rearward. Four transfer rollers 14 are disposed inside the space defined by the belt 13 at positions opposing photosensitive drums 26 of the process unit 20, described later, through the belt 13. A sensor 15 is disposed so as to confront the surface of the belt 13 for detecting a test pattern formed on this surface.

The scanning unit 17 has a laser light-emitting unit (not shown) for irradiating laser beams L onto the photosensitive drums 26 corresponding to each of the four colors yellow, magenta, cyan, and black, for example.

The process unit 20 includes a frame 21, and four developer cartridges 22 (22Y, 22M, 22C, and 22K) corresponding to each of the four colors employed in the printer 1. The developer cartridges 22 are detachably mounted in the frame 21. Each developer cartridge 22 includes a toner-accommodating chamber 23 accommodating toner of the corresponding color, a supply roller 24, and a developing roller 25. A photosensitive drum 26 and a Scorotron charger 27 are mounted in the frame 21 for each of the developer cartridges 22.

The supply roller 24 rotates to supply toner discharged from the toner-accommodating chamber 23 onto the developing roller 25. At this time, the toner is positively tribocharged between the supply roller 24 and developing roller 25. In the meantime, the charger 27 charges the surface of the corresponding photosensitive drum 26 with a uniform positive polarity as the photosensitive drum 26 rotates. Subsequently, the scanning unit 17 exposes the surface of the photosensitive drum 26 with a laser beam L to form an electrostatic latent image on the surface of the photosensitive drum 26 corresponding to an image to be formed on the sheet 3.

Next, the rotating developing roller 25 supplies toner to the surface of the photosensitive drum 26, developing the latent image into a visible image. Subsequently, the toner image carried on the surface of the photosensitive drum 26 is transferred to the sheet 3 by a transfer bias applied to the corresponding transfer roller 14 as the sheet 3 passes between the photosensitive drum 26 and the transfer roller 14.

After the toner images from all photosensitive drums 26 have been transferred onto the sheet 3, the belt unit 11 conveys the sheet 3 to the fixing unit 28. In the fixing unit 28, the toner images are fixed to the sheet 3 by heat. Subsequently, the sheet 3 is discharged onto a discharge tray 29 formed on the top surface of the casing 2.

A cleaning unit 18 is also disposed beneath the belt unit 11. The cleaning unit 18 is provided with a cleaning roller 19 disposed in contact with the belt 13. The cleaning roller 19 functions to recover residual toner from the belt 13 (including test patterns formed on the belt 13 for measuring positional offset of images (registration error) described below.

Electrical Structure of the Printer

Figure 2:
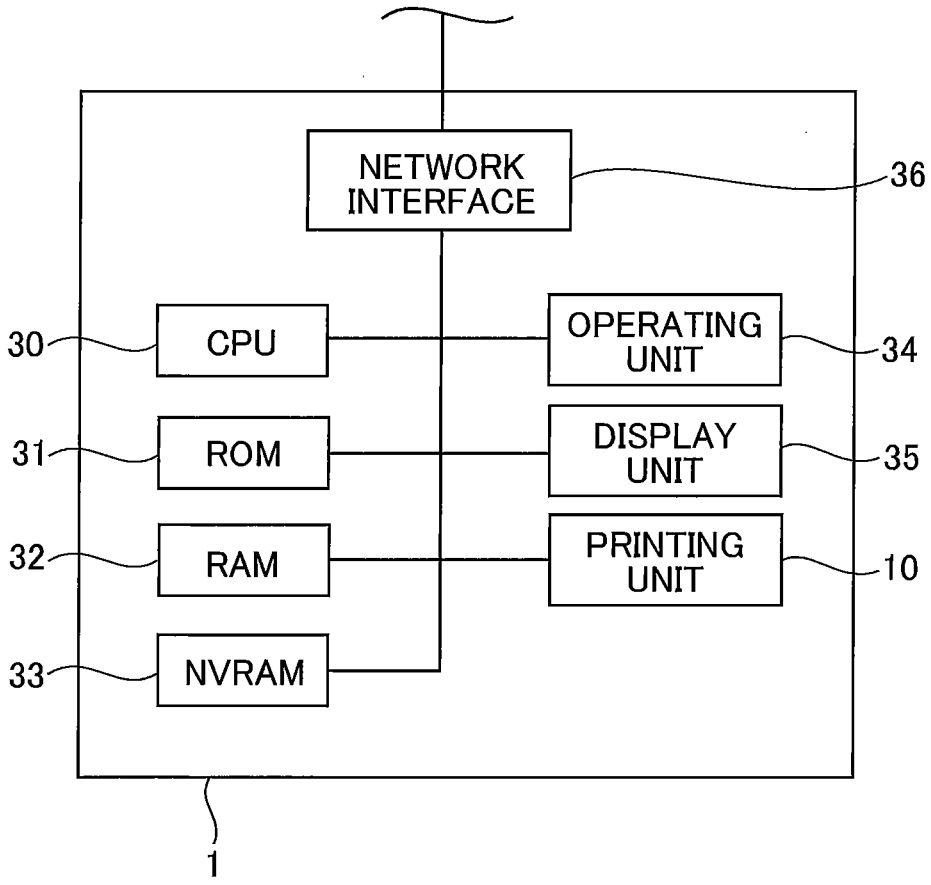
FIG. 2 is a block diagram showing an electrical structure of the printer.

FIG. 2 is a block diagram showing the electrical structure of the printer 1.

As shown in FIG. 2, the printer 1 includes a CPU 30, a ROM 31, a RAM 32, a NVRAM (nonvolatile memory) 33, an operating unit 34, a display unit 35, the printing unit 10, and a network interface 36.

The ROM 31 stores various programs for controlling operations of the printer 1, such as a job execution process described later. The CPU 30 controls the operations of the printer 1 based on programs read from the ROM 31, while storing processing results in the RAM 32 and NVRAM 33. The CPU 30, ROM 31, and RAM 32 may be replaced with a control circuit configured of an application-specific integrated circuit (ASIC).

The operating unit 34 has a plurality of buttons for enabling the user to perform various input operations, such as inputting a command to begin printing. The display unit 35 includes a liquid crystal display and lamps for displaying various setup screens, the operating status of the printer 1, and the like. The network interface 36 can be connected to an external device, such as a computer, facsimile machine, or scanner, and can perform bi-directional communications with the same.

Job Execution Process

FIG. 3 is a flowchart illustrating steps in a job execution process executed on the printer 1 through control by the CPU 30. Upon receiving via the network interface 36 a print job transmitted from an external device (for example, data corresponding to a print request issued by a user from an external device or the operating unit 34), the CPU 30 records this print job in a printing queue stored in the NVRAM 33, for example. The CPU 30 can record a plurality of print jobs in the printing queue, including scheduled jobs specifying printing times, and interrupt jobs.

The CPU 30 also stores data included in each print job recorded in the printing queue in the NVRAM 33. This data may include various printing settings, such as the resolution, number of colors, printing size, sheet type, and a toner saving option; as well as print data in the form of PDL data, bitmap data, facsimile data, scan data, or the like. The print setting for number of colors may be set based on a user-specified printing mode, such as color printing or monochrome printing, for example. The CPU 30 performs the job execution process sequentially for each print job recorded in the queue.

In S1 the CPU 30 determines whether a correction command was received. That is, the CPU 30 references the NVRAM 33 to determine whether a correction command flag has been enabled. The CPU 30 enables the correction command flag when a prescribed condition for executing a correction process is met.

The prescribed condition for executing the correction process is used to determine whether it is necessary (or desirable) to correct positional deviations in image formation in order to maintain good image quality. To give some examples, the CPU 30 may determine that the condition is satisfied when one of the following values exceeds a reference value: (1) the elapsed time since positional deviations among images were measured previously, (2) the number of rotations of the photosensitive drum 26, or (3) an internal temperature change. The CPU 30 may also determine that the condition is satisfied when the user has inputted a correction command on the operating unit 34 or the like.

If a correction command was not received (S1: NO), then in S17 the CPU 30 executes a prescribed process on the image data (a process to develop the data, for example) based on the print settings included in the print job currently being process (hereinafter referred to as the "current job"), transfers the processed data to the printing unit 10, and instructs the printing unit 10 to print an image on a sheet 3 based on the developed data. After this printing process has been performed for all pages in the current job, the job execution process for the current job ends.

However, if a correction command was received (S1: YES), in S3 the CPU 30 determines whether the current job is a job that requires correction. A job that requires correction is a print job for which high-quality printing is required and may satisfy at least one of the following conditions: (1) color printing has been set in the print settings, (2) the resolution set in the print settings exceeds a prescribed level, (3) the toner saving option have not been selected in the print settings, and (4) the print job is not a facsimile job. If the current job is not a job that requires correction (S3: NO), the CPU 30 advances to S17 and performs the same process described above for the case in which a correction command was not received.

(1) When the Current Job is a Job that Requires Correction but Positional Deviation Measurements are not Performed If the CPU 30 determines that the current job is a job requiring correction (S3: YES), in S5 the CPU 30 determines whether the current value of a bypass number stored in the NVRAM 33 exceeds a first reference number, for example. Here, the bypass number indicates the number of times positional deviation measurements (S19) were bypassed (skipped) because a condition for not requiring correction was met. The condition for not requiring correction will be described next.

If the current value of the bypass number does not exceed the first reference number (20, for example; S5: NO), the CPU 30 determines whether the condition for not requiring correction is satisfied. More specifically, in S6 the CPU 30 identifies (extracts) jobs that require correction from among all print jobs currently recorded in the printing queue, including the current job. In S7 the CPU 30 determines whether the ratio of the number of jobs requiring correction to the number of overall print jobs in the printing queue (hereinafter referred to as the "correction job number ratio") is less than a first reference ratio. In the present embodiment, each of the number of jobs requiring correction and the number of overall print jobs corresponds to a numerical value of a print matter. The print matter is not limited to the print job. The print matter may be a quantity of image data, printing area, and pages.

If the correction job number ratio is less than the first reference ratio (S7: YES), then assuming for the moment that the CPU 30 does not reach a negative determination in the following process of S9, in S11 the CPU 30 bypasses the positional deviation measurements and increments the current value of the bypass number by "1". In this way, the CPU 30 gives priority to speed by not executing positional deviation measurements when there are a relatively high number of jobs that do not require correction, rather than giving priority to printing quality by correcting positional deviations when there are a relatively low number of jobs requiring such corrections.

Further, when the CPU 30 determines that the correction job number ratio is less than the first reference ratio (S7: YES), in S9 the CPU 30 determines whether the number of jobs requiring correction is less than a second reference number. As described above, the CPU 30 bypasses positional deviation measurements in S11 as long as the number of jobs requiring correction is less than the second reference number (S9: YES).

In this way, the CPU 30 can give priority to printing speed for jobs not requiring correction when the number of jobs requiring correction is less than a prescribed number (the second reference number). Further, the CPU 30 can give priority to maintaining the printing quality for jobs requiring correction when the number of jobs requiring such correction exceeds the prescribed number, even if the correction job number ratio is less than the first reference ratio (S7: YES), i.e., even when the number of jobs requiring correction is smaller than the number of jobs not requiring correction.

After bypassing positional deviation measurements and incrementing the bypass number in S11, in S13 the CPU 30 modifies the first reference ratio described above based on the new value of the bypass number. Specifically, the CPU 30 reduces the first reference ratio as the value of the bypass number increases based on correlation data for the bypass number and first reference ratio. By reducing the first reference ratio in this way, the CPU 30 can prevent a decline in printing quality caused by repeatedly bypassing the positional deviation measurements over an extended period of time, since these positional deviation measurements will more likely be executed as the bypass number increases.

The table in FIG. 4 shows an example of correlation data for the bypass number and first reference ratio. In this example, the first reference ratio is set to 30% when the bypass number falls within the range 0-4, 20% when the bypass number falls within the range 5-9, 10% when the bypass number falls within the range 10-14, and 5% when the bypass number is 15 or greater. This correlation data is stored in the NVRAM 33, for example, in the form of a table or arithmetic expressions.

In S15 the CPU 30 also modifies the second reference number described above based on the elapsed time since the previous execution of the positional deviation measurements (hereinafter referred to simply as the "elapsed time"). More specifically, the CPU 30 reduces the second reference number as the elapsed time increases based on correlation data for the elapsed time and second reference number. By reducing the second reference number in this way, the CPU 30 can prevent a decline in printing quality that could occur if positional deviation measurements were repeatedly bypassed over an extended period of time, since these positional deviation measurements are more likely to be performed as the elapsed time increases.

The table in FIG. 5 shows an example of correlation data for the elapsed time and second reference number. In this correlation data, the second reference number is set to "4" when the elapsed time is less than 2 hours, "3" when the elapsed time is at least 2 hours but less than 4 hours, "2" when the elapsed time is at least 4 hours but less than 6 hours, and "1" when the elapsed time is 6 hours or greater. When the second reference number is "1", the CPU 30 will always reach a negative determination in S9 and advance to S19 to execute the positional deviation measurements. This correlation data is stored in the NVRAM 33, for example, as a table or arithmetic expressions.

Subsequently, in S17 the CPU 30 executes a printing process on the current job and subsequently ends the job execution process. Thus, in this case the CPU 30 performs a printing process without performing the positional deviation measurements, even though the current job is a job that requires correction.

(2) When the Current Job is a Job that Requires Correction and Positional Deviation Measurements are Performed When the CPU 30 determines in S5 that the bypass number exceeds the first reference number (S5: YES), in S19 the CPU 30 executes the positional deviation measurements, regardless of whether the condition for not requiring correction (S7 and S9) has been met. To perform the positional deviation measurements, the CPU 30 controls the printing unit 10 to print test patterns in each color on the belt 13, controls the sensor 15 to measure the positions of the test patterns, and calculates the amount of positional (color) deviation for each color relative to black, for example. By performing these measurements, the CPU 30 can prevent a decline in printing quality that may occur when bypassing the positional deviation measurements over an extended period of time.

In S21 the CPU 30 resets the bypass number to "0". In S23 the CPU 30 resets the elapsed time to "0" and disables the correction command flag. Next, in S17 the CPU 30 executes a printing process for the current job while adjusting the exposure timing of the scanning unit 17 (i.e., the exposure positions on the photosensitive drums 26) and the like in order to reduce the amount of positional deviations among color images based on the results of the positional deviation measurements. Subsequently, the job execution process ends. In the present embodiment, the exposure timing of the scanning unit 17 corresponds to an operation setting of the printing unit 10.

Further, when the CPU 30 determines in S7 or S9 that the condition for not requiring correction is not met (S7: NO or S9: NO), in S19 the CPU 30 executes the positional deviation measurements prior to executing the current job. The job execution process described above is repeatedly executed while there remain print jobs in the queue. Since the number and type (i.e., requiring or not requiring correction) of print jobs recorded in the queue changes over the course of repeatedly performing the job execution process, the CPU 30 can always determine whether the condition for not requiring correction has been met in the present embodiment based on the latest data recorded in the printing queue.

Effects of the First Embodiment

In the present embodiment described above, the CPU 30 skips the positional deviation measurements when the condition for not requiring correction has been satisfied (S7: YES, S9: YES), even when a correction command was received. Accordingly, the printer 1 of the present embodiment can suppress processing delays for print jobs that do not require correction better than the conventional printing device, which always performs positional deviation measurements regardless of how may print jobs recorded in the queue require correction. Therefore, the printer 1 according to the present embodiment can improve the efficiency of the correcting function.

The printer 1 according to the present embodiment achieves a good balance between being able to quickly execute printing processes for jobs that do not require correction by skipping the positional deviation measurements and being able to maintain a high printing quality for jobs that require correction by executing the positional deviation measurements.

Moreover, by determining whether the condition for not requiring correction is met based on a plurality of print jobs recorded in the printing queue, the printer 1 of the present embodiment can avoid delays in printing processes caused by executing positional deviation measurements for a single print job that requires correction when there are a large number of print jobs succeeding this single print job that do not require correction.

Second Embodiment

Figure 6:
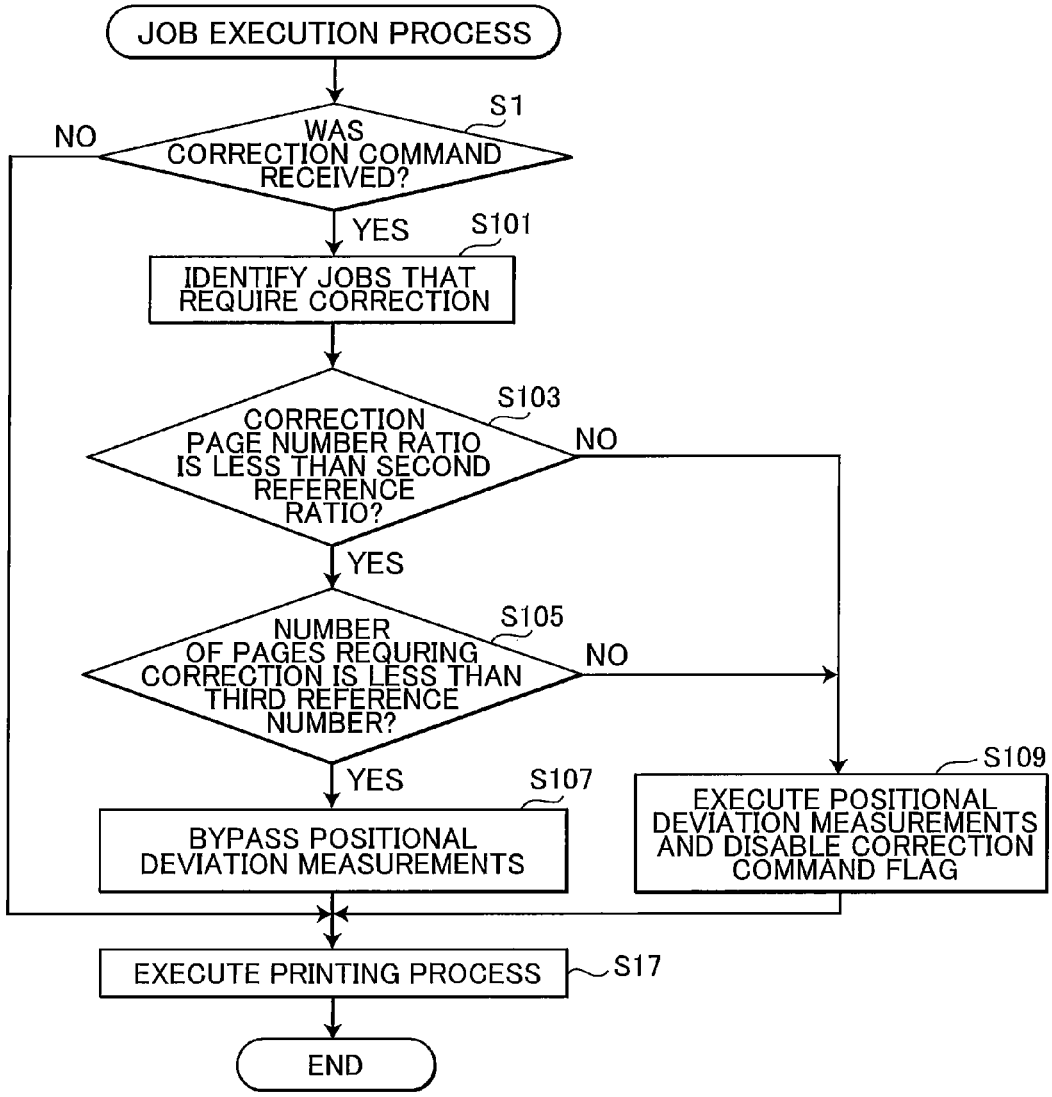
FIG. 6 is a flowchart illustrating steps in the job execution process executed on the printer according to a second embodiment.

FIG. 6 is a flowchart illustrating steps in a job execution process according to a second embodiment. In the first embodiment described above, the CPU 30 determines whether a condition for not requiring correction has been met based on all print jobs recorded in the printing queue. The process performed in the second embodiment is similar to that described in the first embodiment, except that the CPU 30 determines whether the condition for not requiring correction is met based solely on the current job. Therefore, the following description of the second embodiment will focus only on this point of difference, while descriptions overlapping the first embodiment may be omitted.

FIG. 6 is a flowchart illustrating steps in the job execution process performed on the printer 1 through control by the CPU 30. The CPU 30 sequentially performs this job execution process on each print job recorded in the printing queue.

If the CPU 30 determines in S1 that a correction command was received (S1: YES), in S101 the CPU 30 identifies (extracts) pages requiring correction from among image data for the current job. The pages requiring correction are pages for which a high printing quality is necessary, such as color pages or high-resolution pages having a resolution exceeding a prescribed level. Here, a color page will denote a page to be printed using toner of a plurality of colors from among black, yellow, magenta, and cyan, whereas a page printed in toner of a single color will be called a monochrome page. Alternatively, a page formed using toner in a color other than black may be referred to as a color page, rather than a monochrome page.

The CPU 30 determines whether a page in the current job requires correction based on the results of a process to analyze and develop image data for the current job, for example. When data related to resolution or the presence of color page is included in the header of image data, the CPU 30 can perform this determination based on the header data prior to performing a process to analyze and develop data.

The CPU 30 determines whether a condition for not requiring correction has been met based on the results of identifying pages that require correction. More specifically, in S103 the CPU 30 determines whether the ratio of the number of pages requiring correction to the total number of pages in the current job (hereinafter referred to as the "correction page number ratio") is less than a second reference ratio.

If the correction page number ratio is less than the second reference ratio (S103: YES), then assuming for the moment that the CPU 30 does not reach a negative determination in the following process of S105, in S107 the CPU 30 bypasses the positional deviation measurements. In this way, the CPU 30 gives priority to speed by not executing positional deviation measurements when there are a relatively high number of pages that do not require correction, rather than giving priority to printing quality by correcting positional deviations when there are a relatively low number of pages requiring such corrections.

Further, when the CPU 30 determines that the correction page number ratio is less than the second reference ratio (S103: YES), in S105 the CPU 30 determines whether the number of pages requiring correction is less than a third reference number. As described above, the CPU 30 bypasses positional deviation measurements in S107 as long as the number of pages requiring correction is less than the third reference number (S105: YES). In this way, the CPU 30 can give priority to maintaining the printing quality for pages requiring correction when the number of pages requiring such correction exceeds the prescribed number (the third reference number), even if the correction page number ratio is less than the second reference ratio (S103: YES), i.e., even when the number of pages requiring correction is smaller than the number of pages not requiring correction.

Subsequently, in S17 the CPU 30 executes a printing process on the current job and subsequently ends the job execution process. Thus, in this case the CPU 30 performs a printing process without performing the positional deviation measurements, regardless of the print settings for the current job.

If the CPU 30 determines in S103 or S105 that the condition for not requiring correction has not been met (S103: NO or S105: NO), in S109 the CPU 30 executes the positional deviation measurements prior to executing the current job and disables the correction command flag. In S17 the CPU 30 executes the printing process for the current job while adjusting the exposure timing and the like based on the results of the positional deviation measurements. Subsequently, the current job execution process ends. The CPU 30 repeatedly executes the above job execution process while there remain print jobs in the queue.

By determining whether a condition for not requiring correction has been met based on each print job, the printer 1 according to the second embodiment can achieve more accurate determinations than when such determinations are based on a plurality of print jobs.

Variations of the Embodiments

While the invention has been described in detail with reference to specific embodiments thereof, it would be apparent to those skilled in the art that many modifications and variations may be made therein without departing from the spirit of the invention, the scope of which is defined by the attached claims. All components in the preferred embodiments described above, except for the most significant components of the invention, are optional and may be omitted as needed.

(1) While the printer 1 according to the above described embodiments corrects positional deviations in images as the correcting function, the present invention may be applied to a device that corrects densities. Density correction may be achieved by printing test patterns (density patches) on the belt, measuring these densities with a sensor, and correcting the densities based on the measurement results, for example. Further, instead of adjusting the exposure timing, as described in the embodiments, the printing device may be configured to adjust other operation setting, such as the density of images, the resolution of images (a reduction in resolution, for example), or the voltages applied to the developing rollers 25 and transfer rollers 14.

(2) While a direct transfer type color laser printer is described as the printing device in the above described embodiments, the present invention may be applied to an intermediate transfer type laser printer or an inkjet printer, for example.

(3) While print jobs recorded in the printing queue are analyzed to determine whether the condition for not requiring correction has been met, the present invention is not limited to this target of analysis. For example, the printing device may analyze print data recorded in a reception buffer for temporarily recording data received from external devices or may analyze print data stored in an area of memory serving to store print data that has been developed, for example.

(4) While the print data subjected to the job execution processes in the above described embodiments is described as image data received from external devices, the print data subjected to the job execution process according to the present embodiment may be image data stored in the internal memory of the printer 1 or image data acquired from an external memory, for example.

(5) In the first embodiment described above, the CPU 30 determines in S3 whether the current job is a job requiring correction based on the printing settings. However, the printing device may determine whether a job requires correction by analyzing, developing, or performing other processes on the print data for the print job or by reading header data from this print data and by subsequently determining whether the print data actually includes pages requiring high-quality printing, such as color pages or high-resolution pages.

(6) In the job execution process described in the first embodiment, the execution order of the determinations in S7 and S9 may be reversed. Alternatively, the printing device may be configured to perform only one of the determinations in S7 and S9. Further, the execution order of the processes in S13 and S15 may also be reversed. Alternatively, the printing device may be configured to execute only one of these processes.

(7) In the job execution process described in the first embodiment, all print jobs recorded in the printing queue are targeted for the identification process in S6. However, the printing device may be configured to target the current job and only a prescribed number of print jobs following the current job in this identification process, for example.

(8) In S7 of the job execution process described in the first embodiment, the CPU 30 determines whether the correction job number ratio is less than the first reference ratio, but the present invention is not limited to this method. In other words, the printing device may be configured to find the ratio of data requiring correction to print data stored in the printing queue in units of a quantity of image data (number of bytes), units of printing area, or units of pages, rather than units of job numbers.

(9) In S9 of the job execution process described in the first embodiment, the CPU 30 determines whether the number of jobs requiring correction is less than the second reference number, but the present invention is not limited to this method. In other words, the printing device may be configured to find the amount of data requiring correction in units of a quantity of image data (number of bytes), units of printing area, or units of pages, rather than units of job numbers.

(10) In the first embodiment described above, the first reference ratio is decreased as the value of the bypass number increases. However, the printing device may be configured to reduce the second reference number used in S9 of FIG. 3 as the bypass number increases, for example.

(11) In the first embodiment described above, the second reference number is decreased as the elapsed time since the previous positional deviation measurements increases. However, the printing device may be configured to reduce the first reference ratio used in S7 of FIG. 3 as the elapsed time increases, for example. Further, the elapsed time may be measured from the time that positional deviation measurements prior to the previous measurements were performed.

(12) In the first embodiment described above, the CPU 30 determines whether the condition for not requiring correction has been met based on the latest content of the printing queue acquired each time a printing process is performed for a single print job. However, the printing device may determine whether the condition for not requiring correction has been met based on the latest content of the printing queue acquired each time a printing process is performed for two or more print jobs.

(13) In the job execution process according to the second embodiment, the execution order of determinations in S103 and S105 may be reversed. Alternatively, the printing device may be configured to execute only one of these determinations. Further, one or both of the processes in S13 and S15 of FIG. 3 may be added to the job execution process in the second embodiment.

(14) In S103 of the job execution process described in the second embodiment, the CPU 30 determines whether the correction page number ratio is less than the second reference ratio, but the present invention is not limited to this method. In other words, the printing device may be configured to find the ratio of data requiring correction to print data stored in the printing queue in units of a quantity of image data (number of bytes) or units of printing area, rather than units of page numbers.

(15) In S105 of the job execution process described in the second embodiment, the CPU 30 determines whether the number of pages requiring correction is less than the third reference number, but the present invention is not limited to this method. In other words, the printing device may be configured to find the amount of data requiring correction in units of a quantity of image data (number of bytes) or units of printing area, rather than units of page numbers.

What is claimed is:

1. A printing device comprising:

memory configured to store print data;

a printing unit configured to print an image corresponding to the print data and a test image based on an operation setting;

a sensor configured to measure the test image; and a processor configured to:

cause the printing unit to print the test image onto a belt and cause the sensor to measure the printed test image;

extract correction requiring data from the print data stored in the memory, the print data representing a first numerical value of a print matter, the correction requiring data representing a second numerical value of the print matter;

determine whether a prescribed measurement condition is satisfied;

determine whether at least one of two conditions is satisfied upon determining that the prescribed measurement condition is satisfied, one condition being such that a ratio of the second numerical value to the first numerical value is less than a first reference value, another condition being such that the second numerical value is less than a second reference value; and upon determining that the at least one of two conditions is satisfied, bypass measurement by the sensor.

2. The printing device according to claim 1, wherein the processor is further configured to count a number of times that the measurement by the sensor was bypassed because the at least one of two conditions is satisfied, and wherein the first reference value and the second reference value are reduced as the number of times increases.

3. The printing device according to claim 1, wherein the processor is further configured to count a number of times that the measurement was bypassed because the at least one of two conditions is satisfied, and wherein the measurement by the sensor is executed when a value of the number of times exceeds a third reference value.

4. The printing device according to claim 1, wherein the processor is further configured to determine an elapsed time since a previous measurement by the sensor was executed, wherein the first reference value and the second reference value are reduced as the elapsed time increases.

5. The printing device according to claim 1, wherein the print data stored in the memory includes a plurality of sets of print data, and wherein, each time a printing process is performed for one or more sets of print data, the processor is configured to extract the correction requiring data from one or more remaining sets of print data, for which the printing process has not been performed, of the plurality of sets of print data, the first numerical value being represented by the one or more remaining sets of print data, the second numerical value being represented by the extracted correction requiring data.

6. The printing device according to claim 1, wherein the print data stored in the memory includes a plurality of sets of print data, and wherein the processor is further configured to extract the correction requiring data from the plurality of sets of print data, the first numerical value being represented by the plurality of sets of print data, the second numerical value being represented by the extracted correction requiring data.

7. The printing device according to claim 1, wherein the print data stored in the memory includes at least one set of print data, and wherein the processor is further configured to extract the correction requiring data from the one set of print data, the first numerical value being represented by the one set of print data, the second numerical value being represented by the extracted correction requiring data.

8. A non-transitory machine readable medium storing instructions installable on and executable by a printing device, the printing device including memory configured to store print data, a printing unit configured to print an image corresponding to the print data and a test image based on an operation setting, and a sensor configured to measure the test image, the instructions configured to cause the printing device to:

cause the printing unit to print the test image onto a belt and cause the sensor to measure the printed test image;

extract correction requiring data from the print data stored in the memory, the print data representing a first numerical value of a print matter, the correction requiring data representing a second numerical value of the print matter;

determine whether a prescribed measurement condition is satisfied;

upon determining that the prescribed measurement condition is satisfied, determine whether at least one of two conditions is satisfied, one condition being such that a ratio of the second numerical value to the first numerical value is less than a first reference value, another condition being such that the second numerical value is less than a second reference value; and bypass, upon determining that the at least one of two conditions is satisfied, measurement by the sensor.

* * * * *